US010293460B2

(12) United States Patent
Hashimoto et al.

(10) Patent No.: US 10,293,460 B2
(45) Date of Patent: May 21, 2019

(54) METHOD OF PRODUCING POLISHING HEAD AND POLISHING APPARATUS

(71) Applicants: SHIN-ETSU HANDOTAI CO., LTD., Tokyo (JP); SHIN-ETSU ENGINEERING CO., LTD, Tokyo (JP)

(72) Inventors: Hiromasa Hashimoto, Nishigo-mura (JP); Yasuharu Ariga, Nishigo-mura (JP); Masanao Sasaki, Nishigo-mura (JP); Takahiro Matsuda, Annaka (JP)

(73) Assignees: SHIN-ETSU HANDOTAI CO., LTD., Tokyo (JP); SHIN-ETSU ENGINEERING CO., LTD, Tokyo (JP)

( * ) Notice: Subject to any disclaimer, the term of this patent is extended or adjusted under 35 U.S.C. 154(b) by 668 days.

(21) Appl. No.: 14/894,204

(22) PCT Filed: May 12, 2014

(86) PCT No.: PCT/JP2014/002487
§ 371 (c)(1),
(2) Date: Nov. 25, 2015

(87) PCT Pub. No.: WO2014/196128
PCT Pub. Date: Dec. 11, 2014

(65) Prior Publication Data

US 2016/0101503 A1 Apr. 14, 2016

(30) Foreign Application Priority Data

Jun. 4, 2013 (JP) ..... 2013-118245

(51) Int. Cl.
*B24B 37/30* (2012.01)
*B24B 37/04* (2012.01)

(52) U.S. Cl.
CPC ..... *B24B 37/30* (2013.01); *B24B 37/04* (2013.01)

(58) Field of Classification Search
USPC ..... 156/60, 87
See application file for complete search history.

(56) References Cited

U.S. PATENT DOCUMENTS

2003/0173035 A1* 9/2003 Yamaguchi ..... H01L 21/67092 156/580
2011/0136414 A1 6/2011 Masumura et al.
2013/0118684 A1* 5/2013 Ishikawa ..... H01L 21/67092 156/267

FOREIGN PATENT DOCUMENTS

CN 102131617 A 7/2011
EP 1413615 A1 * 4/2004
(Continued)

OTHER PUBLICATIONS

Machine Translation of WO-2010/023829, Date Unknown.*
(Continued)

*Primary Examiner* — Jeffry H Aftergut
(74) *Attorney, Agent, or Firm* — Oliff PLC

(57) ABSTRACT

A method of producing a polishing head including: a backing pad, for holding a workpiece back surface, stuck on a lower portion of a rigid body; and a ring template, for holding a workpiece edge, disposed on a lower surface of the backing pad. This polishing head brings a front surface of the workpiece into sliding contact with a polishing pad attached on a turn table while holding the workpiece back surface on the lower surface of the backing pad. The method includes sticking the backing pad on the lower portion of the rigid body with a double-sided tape under a reduced pressure without heating; and sticking the template on the backing pad with a double-sided tape or a liquid or paste reaction curable adhesive containing no solvent under a reduced
(Continued)

pressure without heating. This method can polish the workpiece into a very flat workpiece.

2 Claims, 9 Drawing Sheets

(56) References Cited

FOREIGN PATENT DOCUMENTS

| | | | | |
|---|---|---|---|---|
| JP | H05-69310 | A | | 3/1993 |
| JP | H11-219872 | A | | 8/1999 |
| JP | 2004-063880 | A | | 2/2004 |
| JP | 2005-007521 | A | | 1/2005 |
| JP | 3607143 | B2 | | 1/2005 |
| JP | 2006-278927 | A | | 10/2006 |
| JP | 2006-278927 | A | * | 10/2006 |
| JP | 2007-123670 | A | | 5/2007 |
| JP | 2007-266068 | A | | 10/2007 |
| JP | 2009-233763 | A | | 10/2009 |
| JP | 2010-247254 | A | | 11/2010 |
| JP | 2010-253756 | A | | 11/2010 |
| WO | 02/056352 | A1 | | 7/2002 |
| WO | 2010/023829 | A1 | | 3/2010 |
| WO | WO-2010/023829 | A | * | 3/2010 |
| WO | 2010/119606 | A1 | | 10/2010 |

OTHER PUBLICATIONS

Machine Translation of JP-2006-278927, Date Unknown.*
Mar. 8, 2016 Office Action issued in Japanese Patent Application No. 2013-118245.
Sep. 2, 2016 Office Action issued in Chinese Patent Application No. 201480031988.6.
Jan. 23, 2017 Office Action issued in Taiwan Patent Application No. 103117788.
Jan. 23, 2017 Search Report issued in Taiwan Patent Application No. 103117788.
Jun. 10, 2014 Search Report issued in International Patent Application No. PCT/JP2014/002487.
Dec. 22, 2015 Office Action issued in Japanese Patent Application No. 2013-118245.
Dec. 8, 2015 Preliminary Report on Patentability issued in International Patent Application No. PCT/JP2014/002487.

* cited by examiner

METHOD OF PRODUCING POLISHING HEAD AND POLISHING APPARATUS

TECHNICAL FIELD

The present invention relates to a method of producing a polishing head for holding a workpiece and a polishing apparatus including the polishing head.

BACKGROUND ART

In production of semiconductor wafers such as silicon wafers, a polishing process is one of important processes to improve surface roughness and flatness of these wafers. As the precision of devices has recently been increased, there is an increasing need for more precisely flattened semiconductor wafers for use in device fabrication. According to this need, chemical mechanical polishing (CMP) is used as a technique to flatten a surface of semiconductor wafers.

Apparatuses for polishing surfaces of a workpiece such as a silicon wafer may be classified into two types: a single-side polishing apparatus that polishes one of the surfaces of the workpiece at a time and a double-side polishing apparatus that polishes both the surfaces simultaneously.

In a conventional CMP process on a semiconductor wafer (also referred to as a wafer below) with a common single-side polishing apparatus, there is a method to hold an opposed surface to a surface to be polished of the wafer by attaching this opposed surface to a glass plate and so on through an adhesive such as wax.

There is also a method to hold and polish the wafer by using a holding plate provided with a backing pad made of a soft resin sheet foam without using an adhesive such as wax; this method is one of the so-called wax-free polishing or wax-less polishing methods.

In a polishing apparatus 38 shown in FIG. 8, for example, a polishing head 31 including a holding disc body 32 made of ceramic, a backing pad 34 and a template 35 having a circular hole configured to surround a workpiece W that are attached to the holding disc body 32 is used to hold one surface of the workpiece W by bringing the workpiece W into close contact with the backing pad 34 containing water. Then, the polishing head 31 and a turn table 37 are rotated and a polishing agent 33 is supplied to a polishing pad 36 attached to the turn table 37 at the same time as the surface to be polished of the workpiece W is pressed to the polishing pad 36 so as to come into sliding contact with the polishing pad 36. In this way, the surface to be polished of the workpiece W can be finished in a mirror surface.

There is a method of attaching a workpiece to a rigid disc plate with higher flatness through an adhesive, such as wax, as a workpiece holding method to flatten the workpiece by a single-side polishing process. If it is necessary to achieve a uniform polishing stock removal, particularly with respect to the entire surface of the workpiece, the so-called rubber-chuck method is used in which a rubber film is used instead of the rigid disc plate that serves as a workpiece holder, and pressurized fluid such as air is caused to flow to the back of the rubber film so that the rubber film is inflated with a uniform pressure to press the workpiece against the polishing pad (See Patent Document 1).

FIG. 9 schematically shows an exemplary configuration of a conventional polishing head using the rubber-chuck method. This polishing head 102 mainly includes an annular rigid ring 104, a rubber film 103 stuck on the rigid ring 104, and a mid plate 105 combined with the rigid ring 104. A sealed space 106 is defined by the rigid ring 104, the rubber film 103, and the mid plate 105. In addition, an annular template 114 is disposed in the vicinity of a lower surface of the rubber film 103 concentrically with the rigid ring 104. The pressure of the space is adjusted by supplying pressurized fluid with a pressure adjustment mechanism 107 disposed at the center of the mid plate 105. The polishing head also includes a means for pressing the mid plate 105 toward the polishing pad 109, but this means is not shown in the figure.

Patent Document 2 proposes various rubber materials used for the rubber film 103 such as fluororubber, isobutylene-isoprene rubber, chloroprene rubber, polyurethane rubber, and silicon rubber that exhibit physical properties of a hardness of 10 to 100, a tensile strength of 3 to 20 MPa, a tensile elongation of 50 to 1000%, and a thickness of 0.2 to 3 mm.

Patent Document 2 discloses metal materials such as stainless steel and aluminum used for the rigid ring 104.

Patent Document 2 also discloses a method of forming the rubber film 103 on the rigid ring 104 by putting the rigid ring 104 and a flexible rubber lump into a metal mold, heating these to 150° C. to 185° C., and compression molding the resultant under a clamping pressure of 1 to 200 tons.

With the polishing head 102 configured as above, the polishing process is performed in a manner that the workpiece W is held by the lower surface of the rubber film 103 though the backing pad 113, the edge of the workpiece W is held by the template 114, and then the mid plate 105 is pressed to bring the workpiece W into sliding contact with the polishing pad 109 attached to the upper surface of the turn table 108.

CITATION LIST

Patent Literature

Patent Document 1: Japanese Unexamined Patent publication (Kokai) No. H5-069310

Patent Document 2: Japanese Unexamined Patent publication (Kokai) No. 2005-7521

Patent Document 3: WO2010/119606

SUMMARY OF INVENTION

Technical Problem

Use of the conventional polishing head 102 of this type for polishing the workpiece W may improve the uniformity of the polishing stack removal of the entire surface of the workpiece W. The rigid ring 104 stuck on the rubber film 103 of the polishing head 102 may however cause the uniformity of polishing stack removal and the flatness of the workpiece to be greatly degraded. Thus, there is the problem in that the uniformity of the polished workpiece W cannot stably maintained.

Patent Document 3 discloses a method of producing a polishing head including measuring the flatness of the lower surface of the rubber film 103 in its circumferential direction at a portion stuck on the lower end surface of the rigid ring 104 under the condition that the rigid ring 104 on which the rubber film 103 is stuck is combined with the mid plate 105, selecting this combination if the measured flatness is 40 μm or less, and using this combination of the rigid ring 104 on which the rubber film 103 having a flatness of 40 μm or less is stuck and the mid plate 105 combined with this rigid ring 104. On this rubber film 103 attached to the rigid ring 104 produced by this method, a commercially available template assembly for holding a workpiece is stuck with a double-sided tape, so that the production of the polishing head is completed. This template assembly uses a backing pad 113 of a polyurethane foam sheet with a double-sided tape and a template 114 made of an epoxy resin lamination plate containing glass cloth that is stuck on the backing pad 113 with a double-sided tape.

This polishing head can hold the workpiece W in a flat state because the rubber film 103 used is flat. When the template assembly is stuck on the surface of the rubber film 103 with a double-sided tape, however, air may enter a gap therebetween, thereby degrading the flatness of the surface of the template 114, which is configured to contact the workpiece. This arises the problem in that the flatness of the polished workpiece W is also degraded.

It is a double-sided tape that sticks the template assembly on the surface of the rubber film 103, as described above. A heat sensitive double-sided tape, which is heated when used for sticking, has a high adhesive strength but needs a comparatively high temperature such as about 100° C. Heating this tape may deform the rubber film 103, the backing pad 113 of a polyurethane foam sheet, and the template 114 made of an epoxy resin lamination plate containing glass plate. Accordingly, the double-sided tape used is a pressure sensitive type. Since this pressure sensitive double-sided tape has a low adhesive strength, the tape is heated to 50° C. when stuck. Even when this tape is heated to about 50° C., however, the rubber film, the backing pad 113 of a polyurethane foam sheet, and the template 114 made of an epoxy resin lamination plate containing glass cloth are thermally deformed. By virtue of the fact that a semiconductor wafer for use in device fabrication needs to be flattened with very high precision, the degradation of wafer flatness due to this thermal deformation is regarded as a problem.

Moreover, the operation of sticking the template assembly when a polishing head is produced requires a skill because this operation is performed manually. This operation also degrades a production yield and efficiency and takes a time, because care is taken in this operation to prevent air from entering.

When the commercially available template assembly is stuck with a double-sided tape by heating this tape to improve the adhesive strength, an automatic press is needed because a heated plate is pressed against these. This arises the problem in that the equipment becomes large and investment is increased.

The present invention was accomplished in view of the above-described problems. It is an object of the present invention to provide a method of producing a polishing head that can inhibit the flatness of the backing pad and the template from being degraded during the production of the polishing head and polish a workpiece into a very flat workpiece.

Solution to Problem

To achieve this object, the present invention provides a method of producing a polishing head including: a backing pad that is configured to hold a back surface of a workpiece and stuck on a lower portion of a rigid body; and a ring template that is configured to hold an edge of the workpiece and disposed on a lower surface of the backing pad, the polishing head being configured to bring a front surface of the workpiece into sliding contact with a polishing pad attached on a turn table while holding the back surface of the workpiece on the lower surface of the backing pad, the method comprising: sticking the backing pad on the lower portion of the rigid body with a double-sided tape under a reduced pressure without heating the backing pad; and subsequently sticking the template on the backing pad with a double-sided tape or a liquid or paste reaction curable adhesive containing no solvent under a reduced pressure without heating the template.

This method can prevent air from entering a sticking portion between the backing pad and the rigid body and a sticking portion between the template and the backing pad during the production of the polishing head, thereby allowing the backing pad and the template to be kept flat. In addition, because each sticking process include no heating process, the backing pad and the template are not thermally deformed, so this method can produce a polishing head that enables a wafer to be polished into a flat wafer. In the sticking process, the same degree of adhesive strength as a conventional method including a heating process can be achieved.

The step of sticking the backing pad preferably includes sticking the backing pad by pressing the backing pad with a pressing component made of a porous material, and/or the step of sticking the template preferably includes sticking the template by pressing the template with a pressing component made of a porous material.

In this manner, when the pressing component is used for pressing in a chamber whose pressure is reduced, this pressure of the chamber can be uniformly reduced because the pressing component is made of a porous material, and air can more reliably be inhibited from entering the sticking portion between the backing pad and the template. The polishing head that enables a wafer to be polished into a flat wafer can consequently be produced more reliably.

The rigid body may be a rigid ring, and the backing pad may be stuck on the lower portion of the rigid ring such that a rubber film stuck on a lower surface of the rigid ring with a uniform tension is interposed therebetween.

In this manner, the method can produce a polishing head using the rubber-chuck method that prevents air from entering the sticking portion between the backing pad and the template and enables a wafer to be polished into a flat wafer.

Furthermore, the present invention provides a polishing apparatus comprising: a polishing pad attached to a turn table; a polishing agent supply mechanism configured to supply a polishing agent to the polishing pad; a polishing head produced by the inventive method, the polishing apparatus being configured to hold a workpiece with the polishing head and bring a front surface of the workpiece into sliding contact with the polishing pad attached to the turn table, whereby the workpiece is polished.

This polishing apparatus that includes a polishing head produced by the inventive method and holds the workpiece with this polishing head to polish a surface of the workpiece can polish a wafer while the wafer is kept flat.

Advantageous Effects of Invention

The inventive method of producing a polishing head includes sticking the backing pad on the lower portion of the rigid body with a double-sided tape under a reduced pressure without heating the backing pad; and subsequently sticking the template on the backing pad with a double-sided tape or a liquid or paste reaction curable adhesive containing no solvent under a reduced pressure without heating the template. This method can thereby prevent air from entering the sticking portions between the rigid body and the backing pad and between the backing pad and the template, thereby enabling the backing pad and the template to be kept flat. In addition, since the sticking process include no heating process, the backing pad and the template can be prevented from being thermally deformed and kept flat. Further, these can be stuck with the same degree of adhesive strength as the conventional method including a heating process for sticking. Use of this polishing head allows a wafer to be polished into a flat wafer.

DESCRIPTION OF EMBODIMENTS

An embodiment of the present invention will hereinafter be described, but the present invention is not limited to this embodiment.

During a process of sticking a backing pad to a rigid body and the backing pad to a template in production of a polishing head, air enters their sticking portions, and the backing pad and the template are thermally deformed by heating, resulting in the degradation of the flatness of the backing pad and the template. Accordingly the flatness of a polished workpiece is degraded.

The present inventors diligently considered to solve this problem, and consequently found the following. The flatness of the backing pad and the template can be inhibited from degrading by a polishing-head producing method including sticking the backing pad on the lower portion of the rigid body with a double-sided tape under a reduced pressure without heating the backing pad; and subsequently sticking the template on the backing pad with a double-sided tape or a liquid or paste reaction curable adhesive containing no solvent under a reduced pressure without heating the template. The inventors thereby brought the invention to completion.

Now, a method of producing a polishing head using the rubber-chuck method will be first described by way of example.

Figure 1:
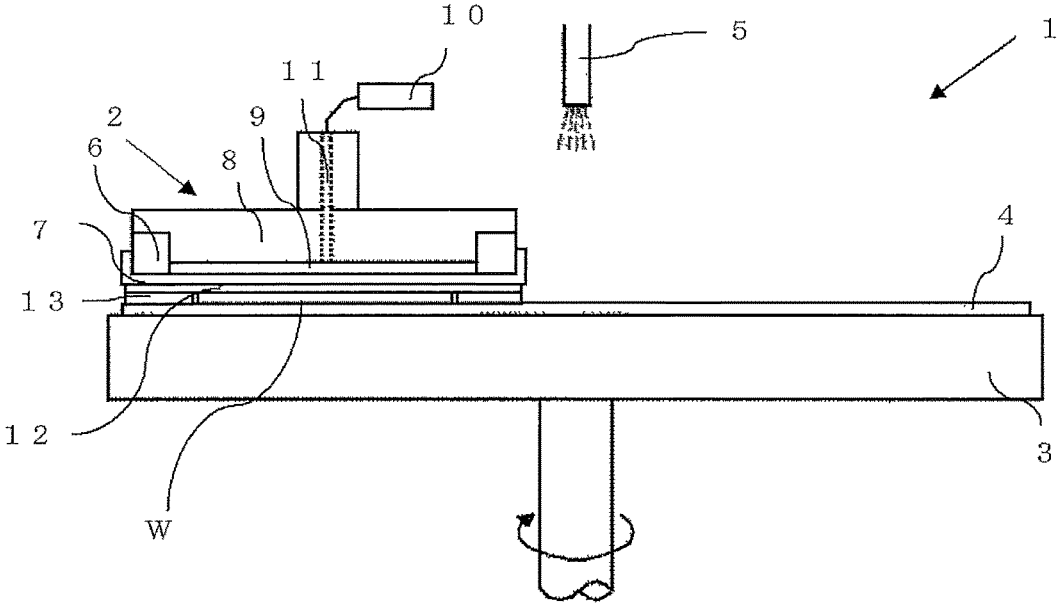
FIG. 1 is a schematic diagram showing an exemplary polishing apparatus including a polishing head using the rubber-chuck method according to the present invention.

FIG. 1 shows an example of the polishing head using the rubber-chuck method produced by the inventive producing method and a polishing apparatus including the polishing head according to the invention.

As shown in FIG. 1, the polishing apparatus 1 includes the polishing head 2, a turn table 3 to which a polishing pad 4 for polishing a workpiece W is attached, and a polishing agent supply mechanism 5 for supplying a polishing agent to the polishing pad 4.

The polishing head 2 produced by the inventive producing method is disposed above the turn table 3. This polishing head 2 includes a rigid ring 6 in the form of a ring, a rubber film 7 stuck on a lower end surface of the rigid ring 6 with a uniform tension, and a mid plate 8 combined with the rigid ring 6, for example, by a bolt. The rigid ring 6, the rubber film 7, and the mid plate 8 define a sealed space 9. The polishing head 2 also includes a pressure adjustment mechanism 10 to adjust the pressure of the space 9. A through-hole 11 connecting with the pressure adjustment mechanism 10 is formed at the center of the mid plate 8 to adjust the pressure. The pressure adjustment mechanism 10 can adjust the pressure of the space 9 by supplying pressurized fluid. The polishing head 2 is rotatable about its axis.

The backing pad 12 to hold the back surface of the workpiece W is stuck below the rigid ring 6 such that the rubber film 7 is interposed therebetween. A ring template 13 to hold the edge of the workpiece is stuck on a lower surface of a circumferential portion of the backing pad 12.

The polishing head 2 of the inventive polishing apparatus 1 is produced by the inventive producing method, which will be described below in detail, in a manner that the backing pad 12 is stuck on the rubber film 7 below the rigid ring 6 with a double-sided tape under a reduced pressure without heating the backing pad 12, and after the backing pad 12 is stuck, the template 13 is stuck on the backing pad 12 with a double-sided tape under a reduced pressure without heating the template 13.

Use of this inventive polishing apparatus 1 to polish the workpiece W allows the polished workpiece to be kept flat.

A method of producing a polishing head according to the invention will be next described.

The inventive method of producing a polishing head includes sticking the backing pad 12 on the rubber film 7 below the rigid ring 6 with a double-sided tape under a reduced pressure without heating the backing pad, and subsequently sticking the template 13 on the backing pad 12 with a double-sided tape or a liquid or paste reaction curable adhesive containing no solvent under a reduced pressure without heating the template 13; this adhesive can be used under a reduced pressure.

The method will be described below in more detail with reference to FIG. 2.

Figure 2:
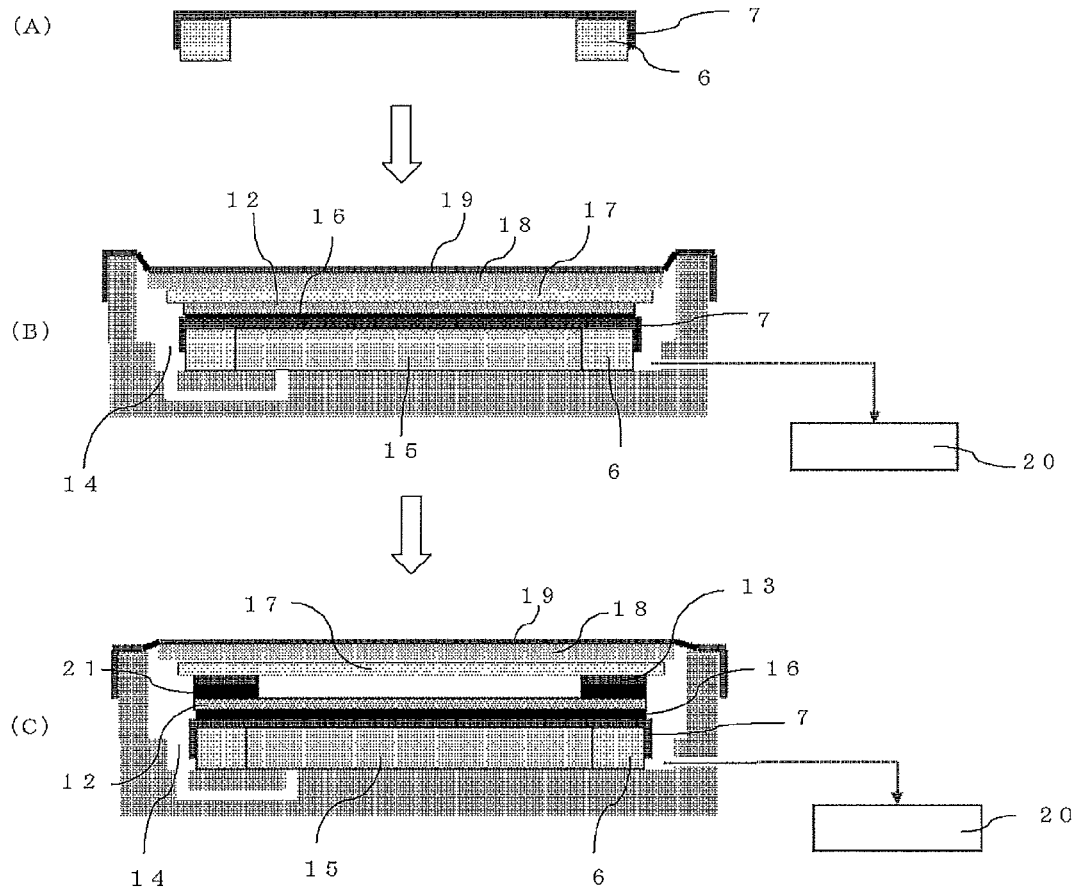
FIG. 2 is a schematic diagram showing an exemplary method of producing a polishing head according to the present invention.

As shown in FIG. 2 at (A), the rubber film 7 attached to the rigid ring 6 having high flatness is first prepared.

As specifically shown in FIG. 2 at (B), a process of sticking the backing pad is performed.

A spacer 15 having an outer diameter that is slightly smaller than the inner diameter of the rigid ring 6 and the same thickness as the rigid ring 6 is inserted inside the rigid ring 6 in a lower portion of a chamber 14. The backing pad 12 is a component with a double-sided tape 16 included in a template assembly before assembling. A release film on one side of this double-sided tape 16 is removed to temporarily attach the backing pad 12 to the surface of the rubber film V.

A pressing component 17 is then placed on the surface of the backing pad 12, and a rubber sheet 19 with a pressing plate 18 disposed on its lower surface is put on the pressing component 17. Air is then evacuated through a hole disposed at a lower portion of the side wall of the chamber 14 connected with a vacuum pump 20, so that the interior of the chamber 14 is replaced with a reduced pressure atmosphere and left. During this period, the pressing component 17 presses the backing pad 12. The pressure of the chamber 14 is then returned to a normal pressure to take out the pressing component 17. In this way, this process of sticking the backing pad is completed. It is to be noted that the reduced pressure is preferably minus 90 kPa or less, and the temperature is preferably in the range from 20° C. to 40° C.

As specifically shown in FIG. 2 at (C), after the backing pad is stuck as above, a process of sticking the template is performed.

A double-sided tape 21 separately prepared is stuck to the template 13 included in the template assembly before assembling, and another release film of the double-sided tape 21 is removed to temporarily attach the template 13 to the surface of the backing pad 12. The pressing component 17 is then placed on the surface of the template 13, and the rubber sheet 19 with the pressing plate 18 disposed on its lower surface is put on the pressing component 17.

Air is then evacuated through the hole disposed at the lower portion of the side wall of the chamber 14 connected with the vacuum pump 20, so that the interior of the chamber 14 is replaced with a reduced pressure atmosphere and left. During this period, the pressing component 17 presses the template 13. The pressure of the chamber 14 is then returned to a normal pressure to take out the pressing component 17. In this way, this process of sticking the template is completed. In these processes, a pressure sensitive double-sided tape can be used as the double-sided tape to stick the backing pad and the template. Alternatively, a liquid or paste reaction curable adhesive containing no solvent that is usable under a reduced pressure can be used to stick the template and backing pad.

The process of sticking the backing pad preferably includes sticking the backing pad 12 by pressing the backing pad 12 with a pressing component made of a porous material, in addition to or alternatively, the process of sticking the template preferably includes sticking the template 13 by pressing the template 13 with a pressing component made of a porous material.

These processes make it easy to uniformly reduce the pressure of the chamber, thereby allowing production of the polishing head without leaving air in the sticking portions of the backing pad 12 and the template 13.

The mid plate 8 is then combined with the rigid ring 6 on which the rubber film 7 is stuck so that the space 9 is defined. The pressure adjustment mechanism 10 is provided above the mid plate 8. A through-hole 11 connected with the pressure adjustment mechanism 10 is provided at the center of the mid plate 8 to adjust the pressure. This process can be performed in the same manner as conventionally. In this way, the polishing head 2 as shown in FIG. 1 is produced.

This method, which includes no heating process for sticking, can stick the rubber film 7, the backing pad 12, and the template 13 without their deformation due to heat when the backing pad 12 is stuck on the surface of the rubber film 7 with a double-sided tape 16, and the template 13 is stuck on the surface of the backing pad 12 with a double-sided tape 21 or a liquid or paste reaction curable adhesive containing no solvent that is usable under a reduced pressure. In addition, the sticking under a reduced pressure allows for inhibiting air from entering the sticking portion and sticking these with the same degree of adhesive strength as the conventional method including a heating process before pressing. Accordingly, the inventive polishing apparatus 1 including the polishing head 2 can polish the workpiece with better flatness.

The inventive method of producing a polishing head can readily be performed and improve a yield. The method can eliminate a need for equipment to press a heated plate such as an automatic press, thereby reducing the cost.

In the above embodiment, the inventive method of producing a polishing head using the rubber-chuck method has been described by way of example. The invention however is not limited thereto. The invention can be applied to production of polishing heads not using the rubber-chuck method, provided these polishing heads are configured to hold a workpiece by the backing pad and the template that are stuck below the rigid body.

Figure 3:
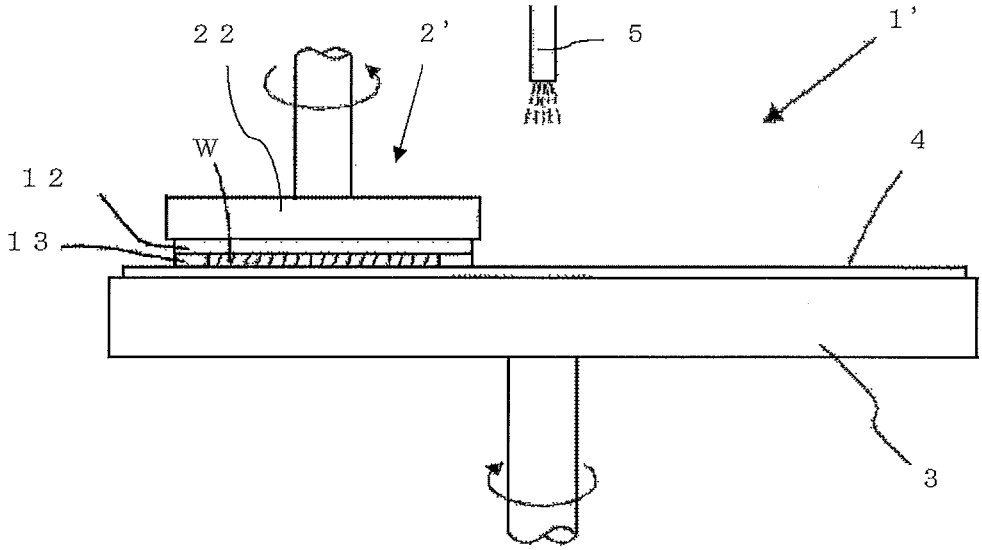
FIG. 3 is a schematic diagram showing an exemplary polishing apparatus according to the present invention.

The inventive producing method can produce a polishing head 2' including the backing pad 12 at a lower portion of a holding disc body 22 and the template 13 stuck on the backing pad 12, for example, as shown in FIG. 3. In this case, the polishing head is produced in the same method as described above: sticking the backing pad 12 on the lower portion of the holding disc body 22 under a reduced pressure without heating the backing pad 12 by using a double-sided tape and subsequently sticking the template 13 on the backing pad 12 under a reduced pressure without heating the template 13 by using a double-sided tape or a liquid or paste reaction curable adhesive containing no solvent that is usable under a reduced pressure. This method can inhibit the degradation of the flatness of the backing pad and the template likewise.

The inventive polishing apparatus 1' including this polishing head 2' can likewise polish the workpiece with better flatness.

Example

The present invention will be more specifically described below with reference to an example and a comparative example, but the invention is not limited to this example.

Example

A polishing head as shown in FIG. 1 was produced by the inventive producing method. The flatness of a surface of the template and the backing pad was measured. A silicon wafer was then polished with the inventive polishing apparatus including this polishing head as shown in FIG. 1. The flatness of the polished silicon wafer was measured to evaluate SFQRmax.

Now, production of the polishing head in this example will be described.

A rubber film attached to a 360-mm-diameter titanium rigid ring with high flatness was made by putting the rigid ring into a metal casting mold and then injecting an EPDM rubber material having a JIS A hardness of 50° into the metal casting mold. This rubber film had a uniform thickness of 1 mm.

In the sticking processes, the following backing pad and template were used. The backing pad of a polyurethane foam sheet and template of an epoxy resin lamination plate containing glass cloth, both on which a double-sided tape was stuck, were obtained from a commercially available template assembly having a recess with a diameter of 302 mm before assembled. This template assembly is normally assembled by sticking a double-sided tape on the backing pad and also sticking this backing pad on the template with a heat sensitive double-sided tape. A pressure sensitive double-sided tape was separately prepared. This template had a thickness of 0.8 mm and a diameter of 360 mm.

A 320-mm-diameter pressing component made of porous ceramic was used to press the surface of the backing pad. A pressing plate made of stainless steel was used to press the pressing component from above.

In the sticking processes of the backing pad and the template, the pressure of the chamber after air was evacuated was minus 90 kPa (1400 kgf). The state of reduced pressure was left for 45 minutes.

Figure 4:
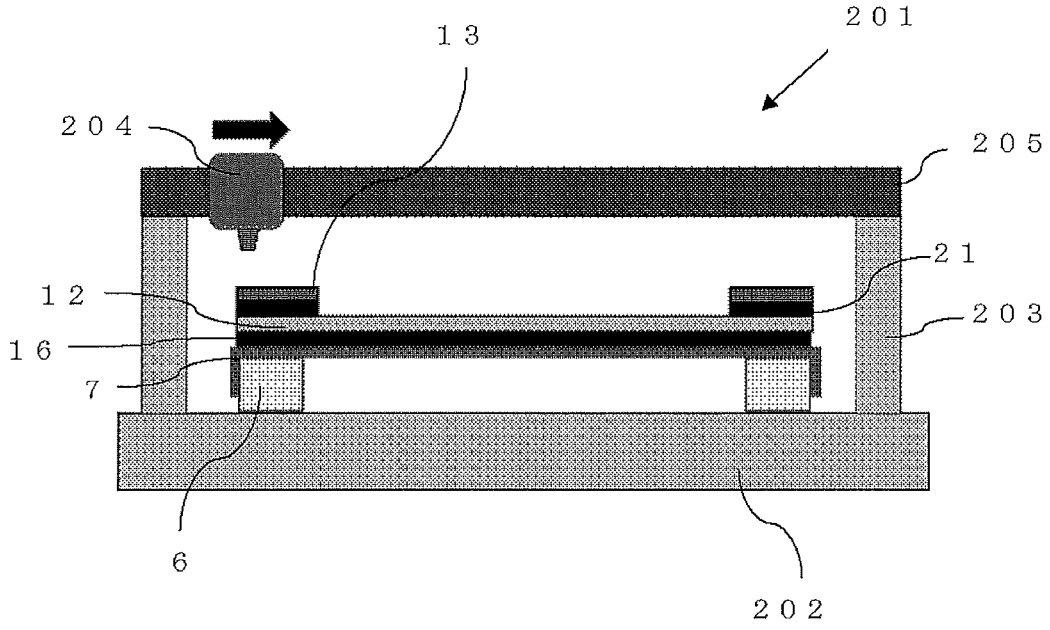
FIG. 4 is a schematic diagram of an apparatus for measuring flatness in Example.

FIG. 4 shows an apparatus 201 for measuring the flatness of the surface of the template and the backing pad. A portal 203 was mounted on a reference surface plate 202. A ceramic air slider 205 having a length of 450 mm was disposed at an upper part. A plate to which a laser displacement meter 204 was fixed was installed at a moving part of the air slider. The parallelism between the air slider 205 and the reference surface plate 202 was adjusted in advance; the degree of this parallelism was 0.01 mm or less for 450 mm.

The backing pad, the template, and the rubber film to which the rigid ring was attached that were stuck according to the invention were placed on the reference surface plate 202 such that the template was disposed on the upper side. The flatness of the surface of the template and the backing pad was measured with the measurement apparatus 201.

Polishing was performed by using the produced polishing head. A subject to be polished was a silicon wafer having a diameter of 300 mm. Commercial colloidal silica slurry was used as a polishing agent. Colloidal silica having an average diameter of 35 nm to 70 nm was used as abrasive grains. This colloidal silica was deluded with pure water. Potassium hydroxide was added to the resultant solution such that pH was 10.5. Commercially available nonwoven fabric polishing pad was used. In the polishing, the polishing head and the turn table were rotated at 30 rpm. The polishing pressure (the pressure of fluid) on the wafer was 150 g/cm$^2$. After cleaning, the flatness of the polished wafer was measured with WaferSight made by KLA-Tencor to evaluate SFQRmax.

Comparative Example

The flatness of the surface of the template and the backing pad was measured under the same conditions as the above example except that a polishing head was produced by a conventional producing method using thermocompression bonding. A silicon wafer was then polished with a polishing apparatus under the same conditions except that this polishing apparatus included the polishing head produced by the conventional producing method using thermocompression bonding. The flatness of the polished silicon wafer was measured to evaluate SFQRmax.

The conventional producing method using thermocompression bonding in this comparative example will be described below.

Figure 5:
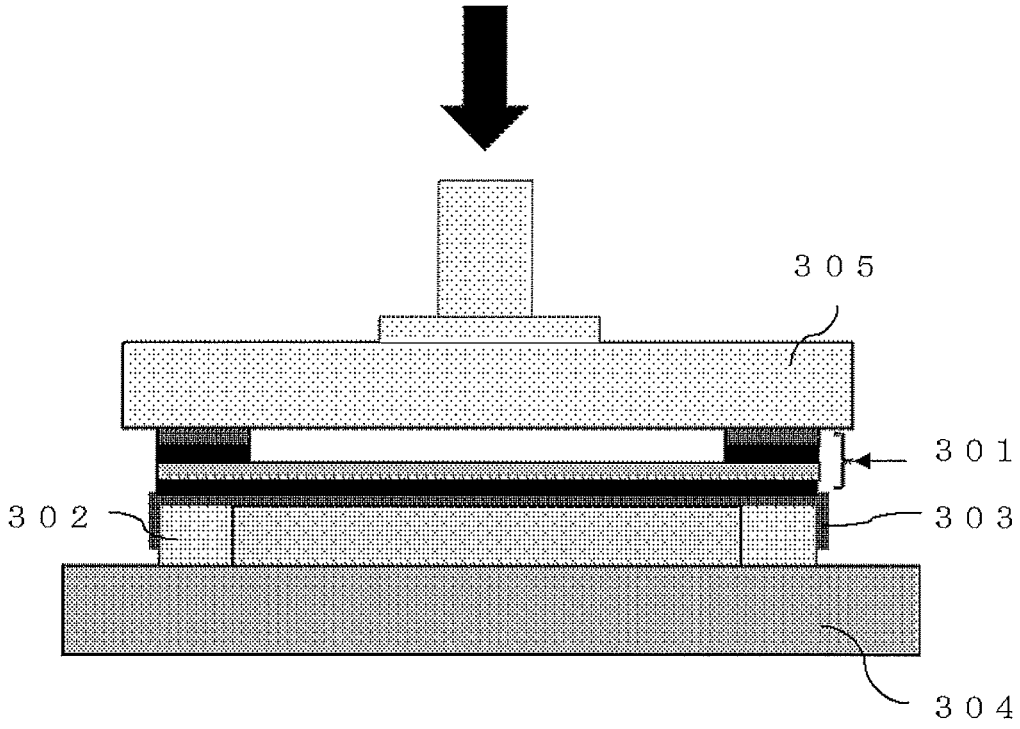
FIG. 5 is a schematic diagram showing an example of a conventional method of producing a polishing head that uses thermocompression bonding.

As shown in FIG. 5, a template assembly 301 was temporarily attached to a rubber film 303 to which a rigid ring 302 was stuck, and then the resultant was placed on a surface plate 304 such that the template assembly 301 was disposed on the upper side. These were pressed by a thermocompression bonding plate 305 heated to 50° C. under a pressure of 393 kgf for 45 minutes to stick the interposed rubber film, the rigid ring, the backing pad, and the template. The temperature was then decreased to room temperature to compete the sticking processes.

In this comparative example, the flatness of the surface of the template and the backing pad was measured with the measurement apparatus 201 shown in FIG. 4 before and after the thermocompression bonding.

Figure 6:
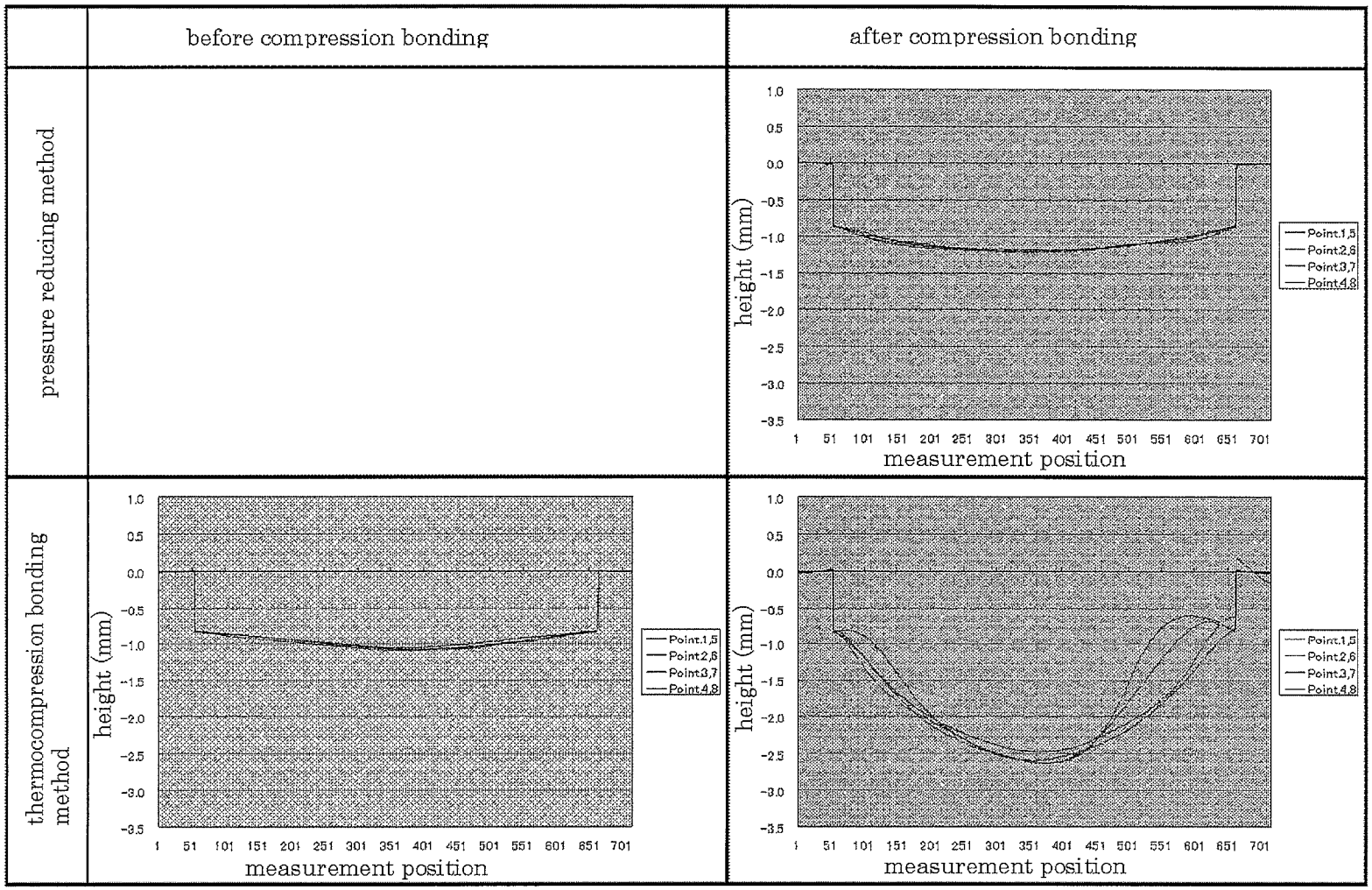
FIG. 6 is a diagram showing the flatness of a surface of a backing pad and a template in Example and Comparative Example.

As shown in FIG. 6, in this comparative example, the surface of the template before the thermocompression bonding was substantially flat; the flatness of the backing pad was about 0.2 mm. However, the surface of the template after the thermocompression bonding was formed into a tapered shape of 0.3 mm; the flatness of the backing pad was degraded to about 1.5 mm.

In contrast, the compression bonding under a reduced pressure in the example maintained a flat surface of the template flat and improved the flatness of the backing pad to about 0.3 mm. It was thus confirmed that the inventive method of producing a polishing head can inhibit the degradation of the flatness.

Figure 7:
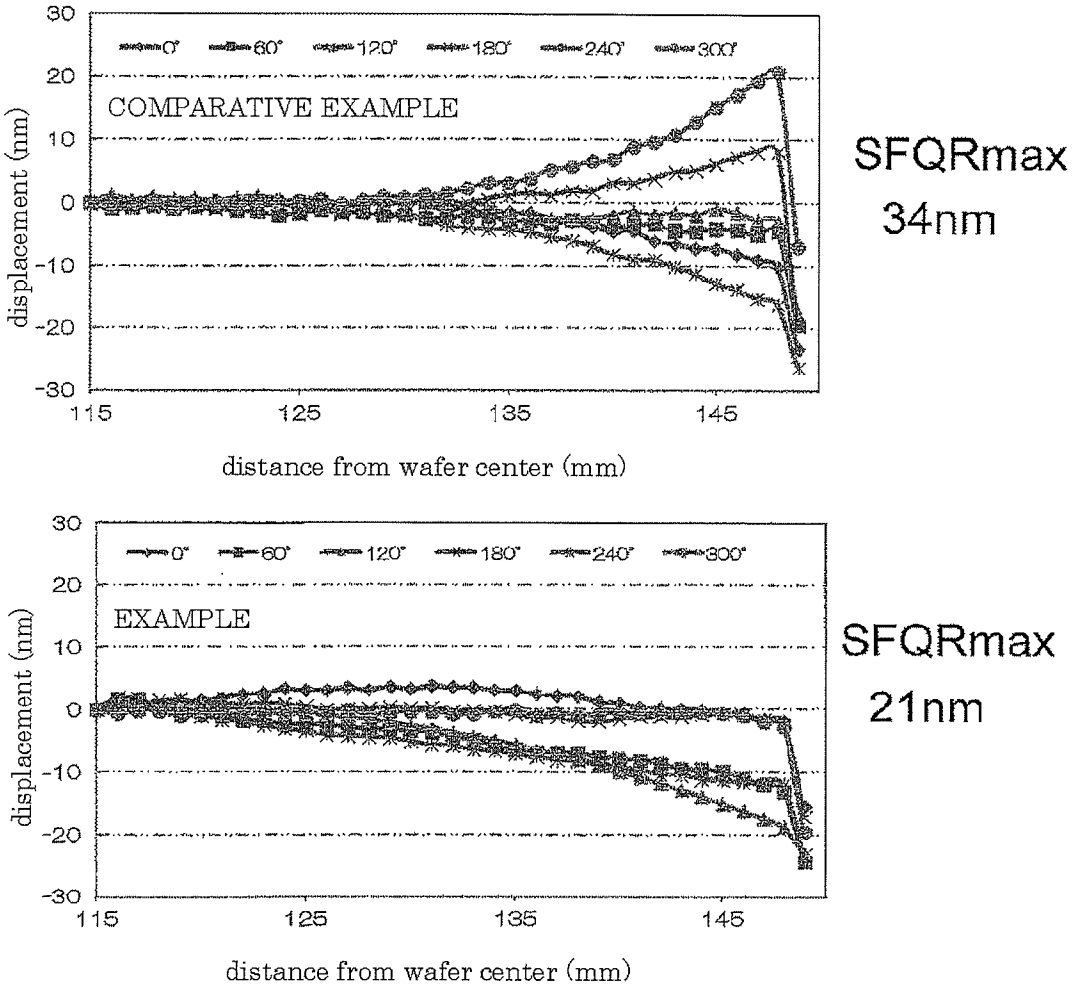
FIG. 7 is a diagram showing the flatness of a polished silicon wafer in Example and Comparative Example.
Figure 8:
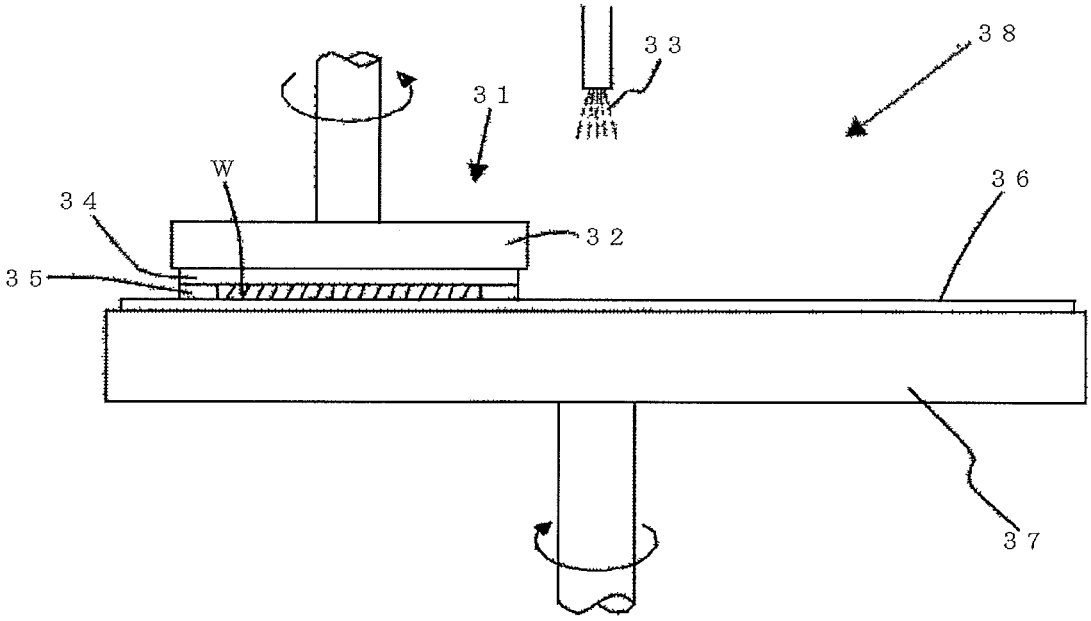
FIG. 8 is a schematic diagram showing an example of a common polishing apparatus.
Figure 9:
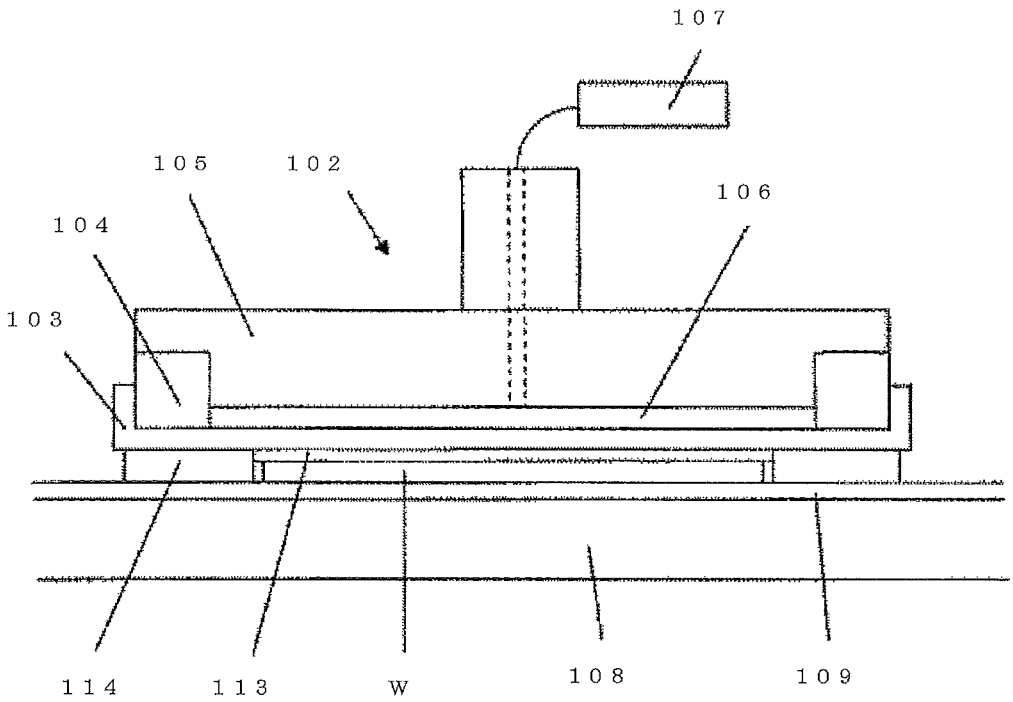
FIG. 9 is a schematic diagram showing an exemplary configuration of a common polishing head using the rubber-chuck method.

As shown in FIG. 7, many wafers having both a rise shape and a sag shape were observed among the silicon wafers polished with the polishing apparatus in the comparative example. The SFQRmax of these wafers was degraded to 34 nm. The example demonstrated that the shape of the outer circumference of all the wafers was flat or a slight sag shape; the SFQRmax was a good value of 21 nm. It was thus confirmed that the inventive polishing apparatus can obtain a very flat silicon wafer.

It is to be noted that the present invention is not limited to the foregoing embodiment. The embodiment is just an exemplification, and any examples that have substantially the same feature and demonstrate the same functions and effects as those in the technical concept described in claims of the present invention are included in the technical scope of the present invention.

Although the template and the backing pad used to assemble a commercially available template assembly were used in the above example, the template and the backing pad are not limited thereto and any template and backing pad can be used, provided the template and the backing pad can hold the edge and the back surface of a workpiece.

The invention claimed is:

1. A method of producing a polishing head comprising: a backing pad that is configured to hold a back surface of a workpiece and stuck on a lower portion of a rigid body; and a ring template that is configured to hold an edge of the workpiece and disposed on a lower surface of the backing pad, the polishing head being configured to bring a front surface of the workpiece into sliding contact with a polishing pad attached on a turn table while holding the back surface of the workpiece on the lower surface of the backing pad, the method comprising:

sticking the backing pad on the lower portion of the rigid body with a double-sided tape under a reduced pressure without heating the backing pad; and subsequently sticking the template on the backing pad with a double-sided tape or a liquid or paste reaction curable adhesive containing no solvent under a reduced pressure without heating the template, wherein the step of sticking the backing pad comprises sticking the backing pad by pressing the backing pad with a pressing component made of porous material, and/or the step of sticking the template comprises sticking the template by pressing the template with a pressing component made of a porous material, thereby inhibiting air from entering a sticking portion between the backing pad and/or the template.

2. The method according to claim 1, wherein the rigid body is a rigid ring, and the backing pad is stuck on the lower portion of the rigid ring such that a rubber film stuck on a lower surface of the rigid ring with a uniform tension is interposed therebetween.

* * * * *